US006675536B1

(12) United States Patent
Williams et al.

(10) Patent No.: US 6,675,536 B1
(45) Date of Patent: Jan. 13, 2004

(54) DOOR FRAME CLOSING AND SECURING APPARATUS

(75) Inventors: Brent Williams, Fort Worth, TX (US); Richard Anthony, Fort Worth, TX (US); Aravind Seshadri, Fort Worth, TX (US); Nicholas A. Teufel, Fort Worth, TX (US); James H. Kim, Fort Worth, TX (US); Kisoo Jung, Fort Worth, TX (US); Kartik Moorthy, Irving, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 0 days.

(21) Appl. No.: 10/210,459

(22) Filed: Jul. 31, 2002

(51) Int. Cl.[7] ..... E05C 9/00

(52) U.S. Cl. ..... 49/395; 292/38

(58) Field of Search ..... 49/1, 2, 394, 395; 292/38, 141, 171, DIG. 69

(56) References Cited

U.S. PATENT DOCUMENTS

| | | | | | |
|---|---|---|---|---|---|
| 4,971,369 | A | * | 11/1990 | Jean | 292/36 |
| 5,086,587 | A | * | 2/1992 | Andrews | 49/395 |
| 6,101,764 | A | * | 8/2000 | Guy-Paul | 49/395 |
| 6,123,370 | A | * | 9/2000 | Rozema et al. | 292/47 |
| 6,446,393 | B1 | * | 9/2002 | Marston et al. | 49/395 |

* cited by examiner

*Primary Examiner*—Jerry Redman
(74) *Attorney, Agent, or Firm*—Arthur F. Zobal; Geoffrey A. Mantooth

(57) ABSTRACT

The apparatus is used for closing and securing a door in its frame. A movable wedge is supported in a slot in the frame. A closing mechanism is employed for closing the door and a second mechanism is employed for moving the wedge into a slot formed in the edge of the door when the door is closed. A shape memory wire is used in conjunction with the closing mechanism for allowing the closing mechanism to close the door. A second shape memory wire is used in conjunction with the second mechanism for allowing the second mechanism to move the wedge from the frame slot into the door slot when the door is closed for securing the door to the frame.

7 Claims, 15 Drawing Sheets

FIGURE 22
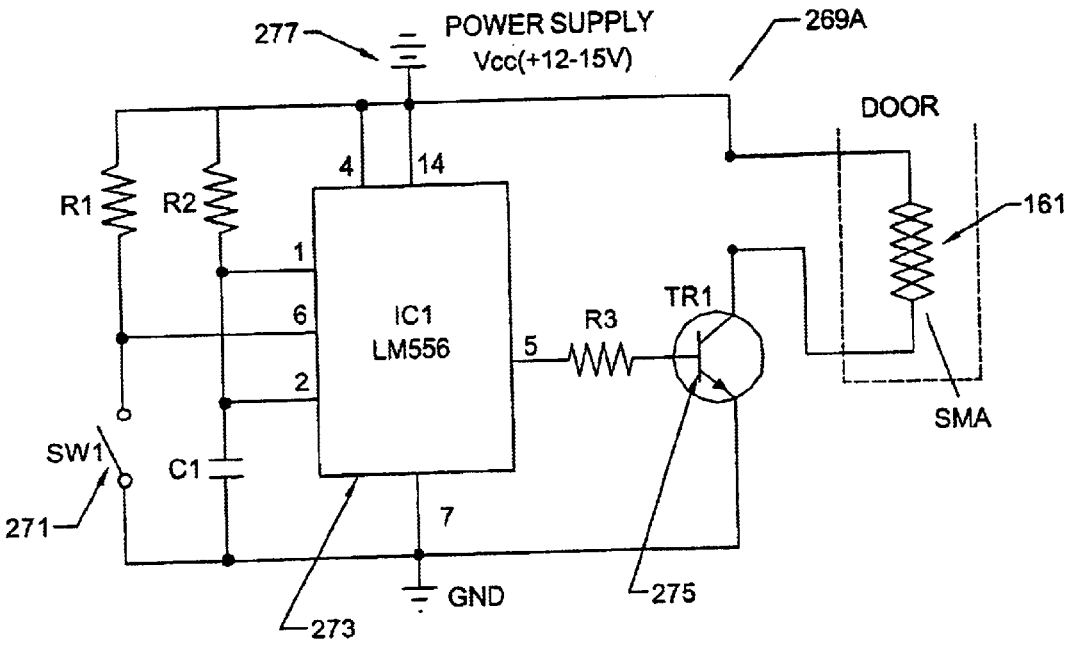
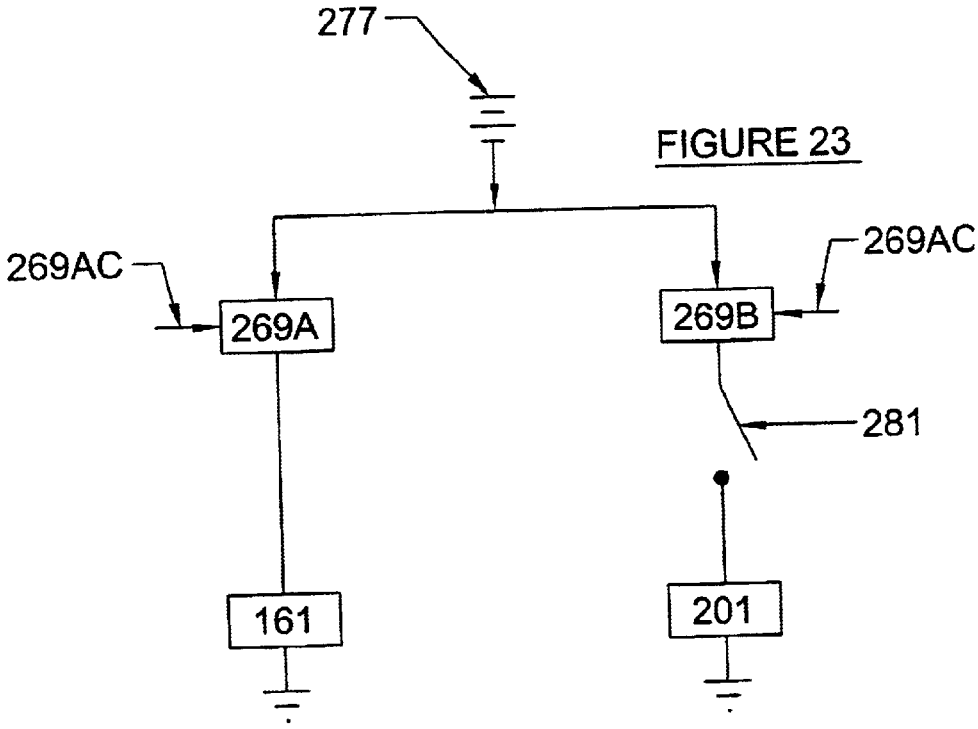
FIGURE 23

DOOR FRAME CLOSING AND SECURING APPARATUS

BACKGROUND OF THE INVENTION

1. Field of the Invention

The invention relates to an apparatus for closing and securing a door to a frame.

2. Description of the Prior Art

On ships and boats a need exists for a mechanism for closing and securing doors in their frames in the event of an emergency. U.S. Pat. No. 3,816,966 discloses one type of closing and securing mechanism.

SUMMARY OF THE INVENTION

It is an object of the invention to provide a new and useful apparatus for closing and securing a door in its frame in the event of an emergency.

The apparatus comprises a movable wedge supported in a slot in the frame, a closing mechanism for closing the door, and a second mechanism for moving the wedge into a slot formed in the edge of the door when the door is closed. In one aspect, the invention comprises a shape memory wire used in conjunction with the closing mechanism for allowing the closing mechanism to close the door.

In a further aspect, the invention comprises the use of a second shape memory wire is used in conjunction with the second mechanism for allowing the second mechanism to move the wedge from the frame slot into the door slot when the door is closed for securing the door to the frame.

A trigger is employed to normally prevent the closing mechanism from closing the door. The first shape memory wire is heated by an electrical output to release the trigger to allow the closing mechanism to close the door.

In the embodiment disclosed, the closing mechanism comprises a spring biased closing means coupled to the hinge for moving the hinge and hence the door to a closed position.

The wedge is held in the frame slot by a second trigger to which the second shape memory wire is coupled. A spring biased wedge moving means normally urges the wedge toward the door slot. The wedge is allowed to move into the door slot by applying an electrical output to the second memory shape wire to release the second trigger to allow the spring biased wedge moving means to move the wedge into the door slot.

A handle is employed to allow the wedge to be moved out of the door slot into the frame slot.

In the embodiment disclosed, three sides of the frame have slots for holding wedges for movement into and out of slots formed in three sides of the door. The wedges normally are biased outward toward the respective door slots by springs which are held in place by triggers. Shape memory wires when heated by electrical outputs release the triggers to allow the springs to move the wedges into the door slots. The handle is employed to move all of the wedges from the door slots.

DESCRIPTION OF THE PREFERRED EMBODIMENTS

FIG. 22 is a power supply circuits for one of the SMA wires.

FIG. 23 is a block diagram of a pair of power supply circuits.

DETAILED DESCRIPTION OF THE PREFERRED EMBODIMENTS

Figure 1:
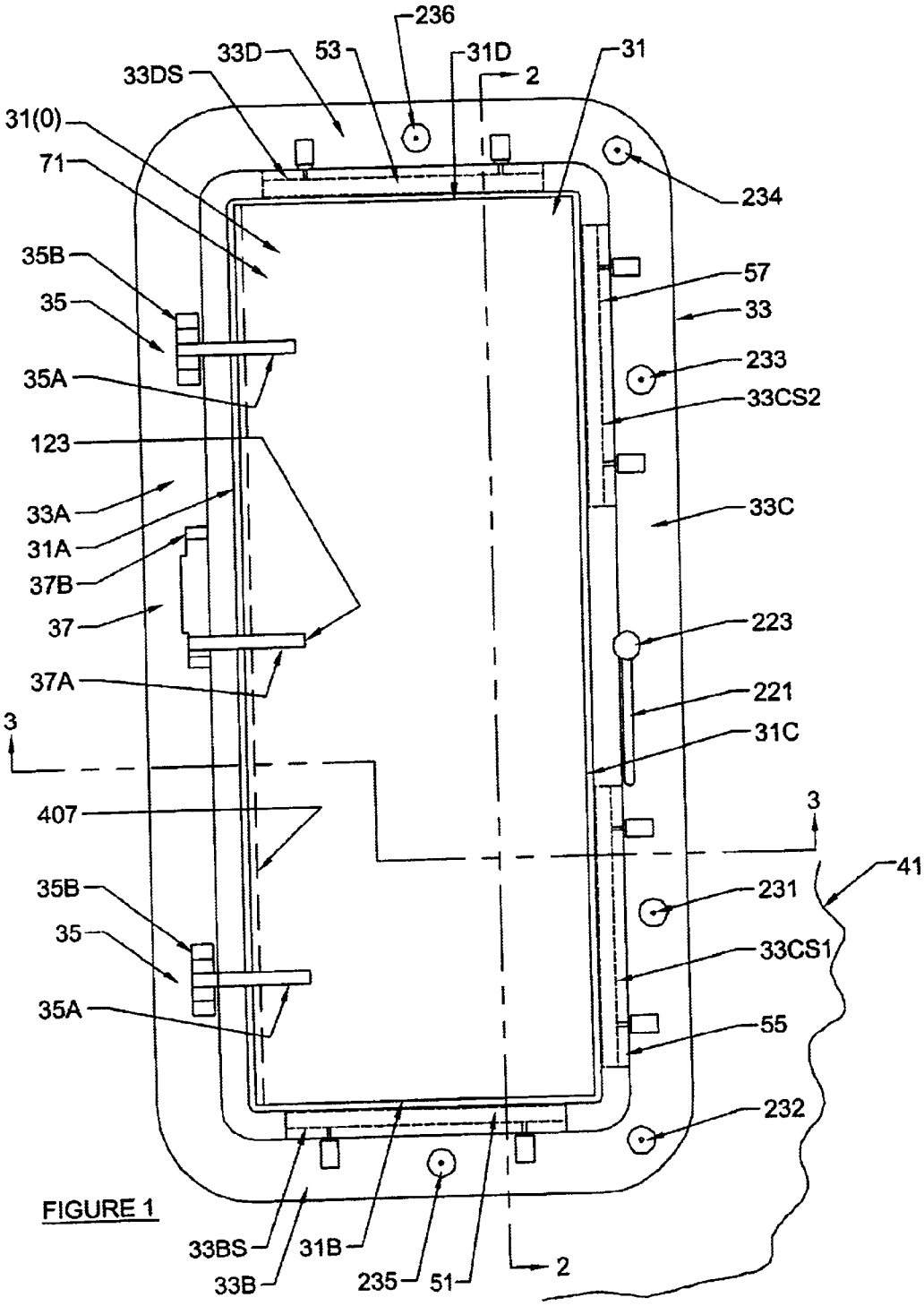
FIG. 1 illustrates a door mounted in a door frame with wedges in the frame slots.
Figure 2:
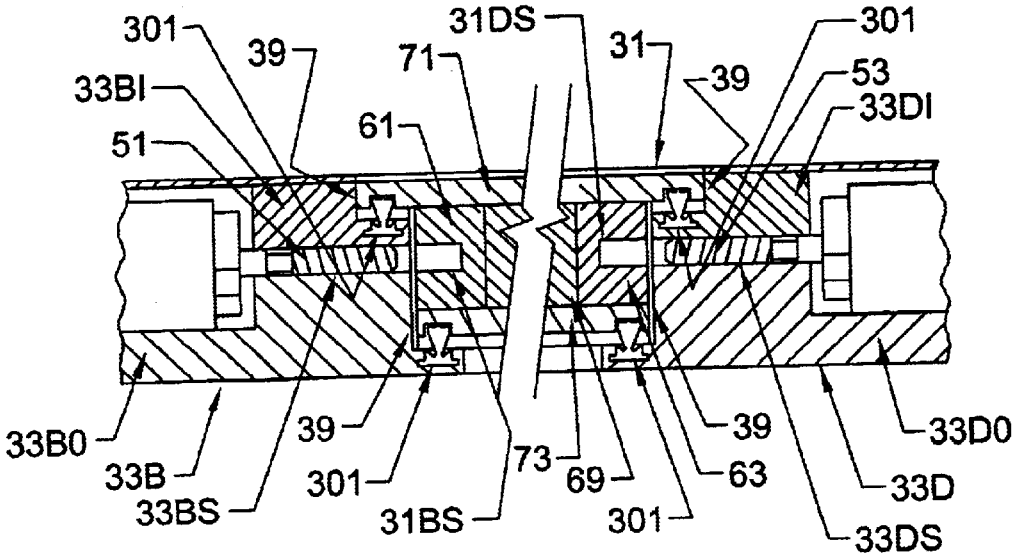
FIG. 2 is a cross-section of FIG. 1 taken along the lines 2—2 thereof.

Referring now to FIGS. 1–7 of the drawings, there is illustrated a door 31 coupled to a frame 33 by hinges 35 and 37 for opening and closing an opening or passageway 39 formed through the frame 33. The frame 33 is coupled to a bulkhead 41 which may form part of the structure of a ship or boat. The frame 33 comprises four members 33A, 33B, 33C, 33D which form the opening 39. The door 31 comprises four edges 31A, 31B, 31C, 31D. The door 31 may be formed of a suitable metal such as aluminum or a composite. The frame 33 may be formed of a suitable metal. The hinges 35 are similar to each other and each comprises a hinge member or arm 35A secured to the outer side 31(O) of the door near edge 31A. Each of the members 35A is pivotally coupled to a base 35B which is secured to the frame member 33A. The hinge 37 also comprises a member 37A secured to the outer side 31(O) of the door 31 near edge 31A. Member 37A is pivotally coupled to a base 37B which is secured to the frame member 33A.

The frame members 33B and 33D each have an elongated slot 33BS and 33DS formed in its inner edge for completely receiving and holding movable elongated wedges 51 and 53 respectively. The frame member 33C has two spaced apart elongated slots 33CS1 and 33SC2 formed in its inner edge for completely receiving and holding two movable elongated wedges 55 and 57.

Figure 5:
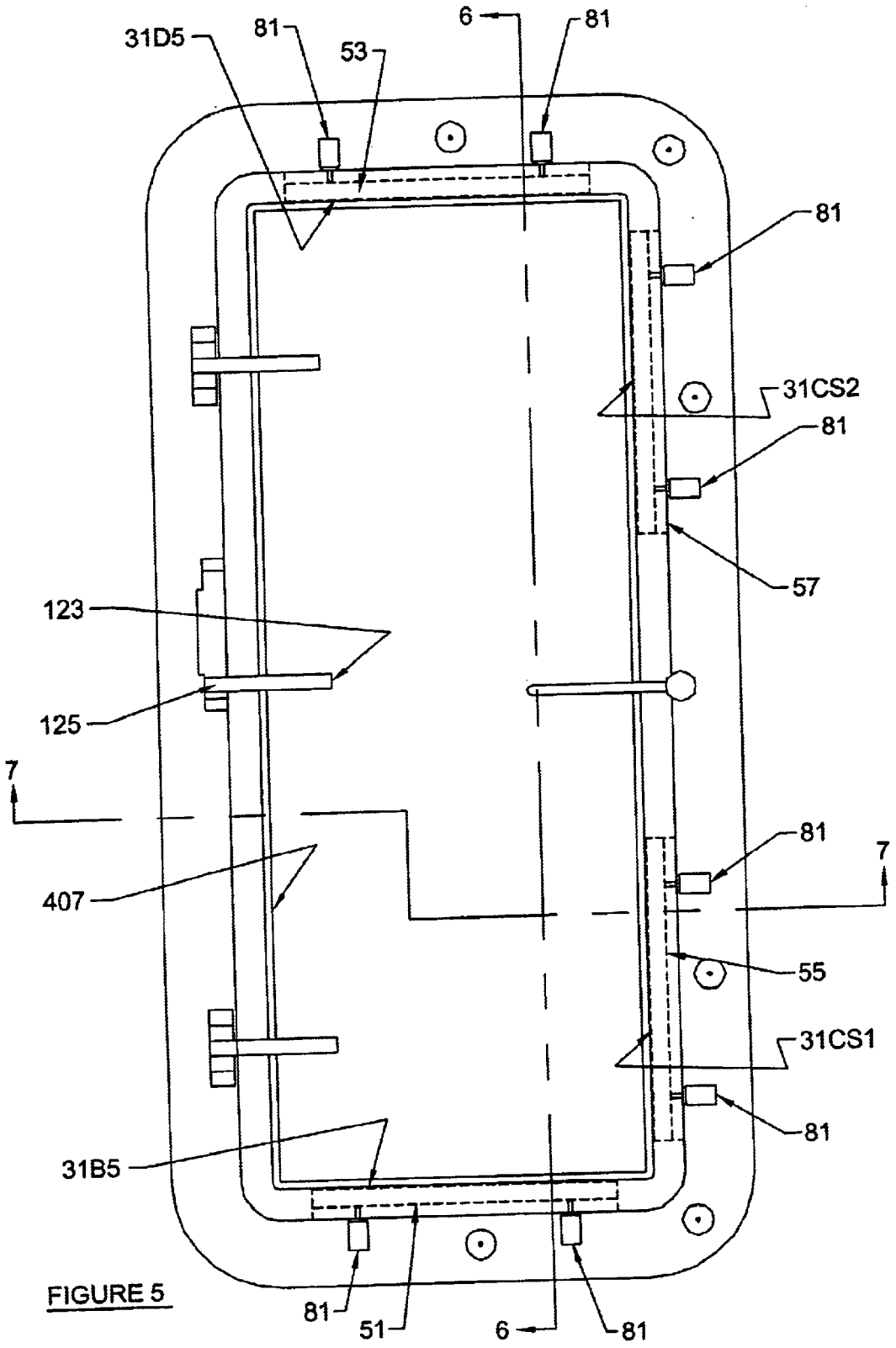
FIG. 5 illustrates the door of FIG. 1 mounted in the door frame with wedges extending into the door slots.
Figure 6:
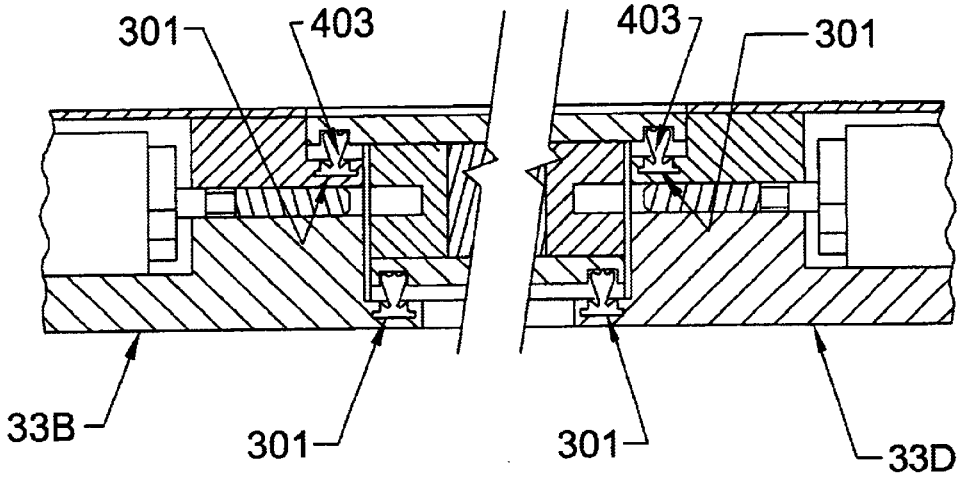
FIG. 6 is a cross-section of FIG. 5 taken along the lines 6—6 thereof.
Figure 7:
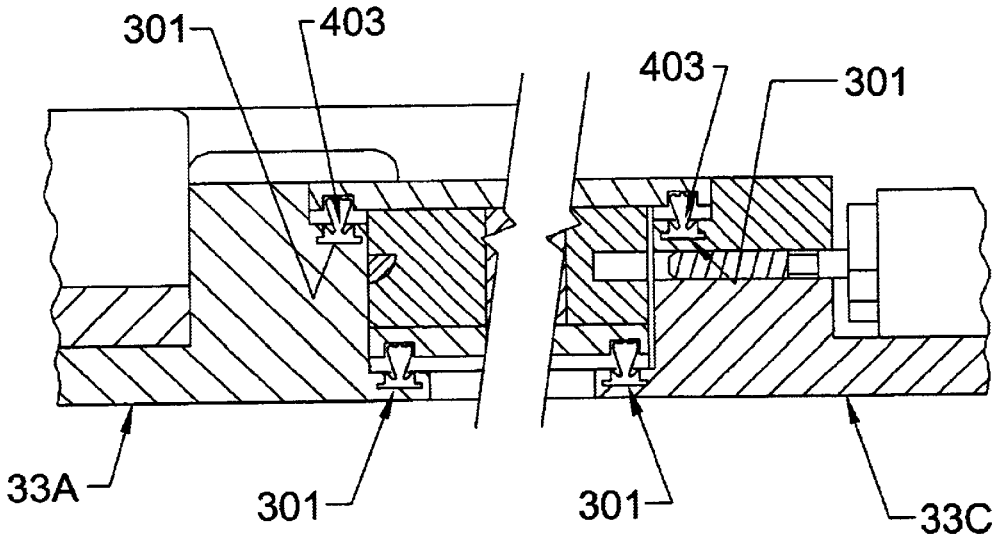
FIG. 7 is a cross-section of FIG. 5 taken along the lines 7—7 thereof.

The door edges 31B and 31D each have an elongated slots 31BS and 31DS for partially receiving the wedges 51 and 53 respectively. The door edge 31C has two spaced apart elongated slots 31CS1 and 31CS2 for partially receiving the wedges 55 and 57 respectively. When the wedges 51, 53, 55, and 57 are completely located in their frame slots 33BS, 33DS, 33CS1, 33CS2 respectively as shown in FIGS. 1–4 the door 31 may be opened. When the wedges 51, 53, 55, and 57 are partially located in the door slots 31BS, 31DS, 31CS1, 31CS2, as shown in FIGS. 5–7, the door 31 cannot be opened.

Figure 18:
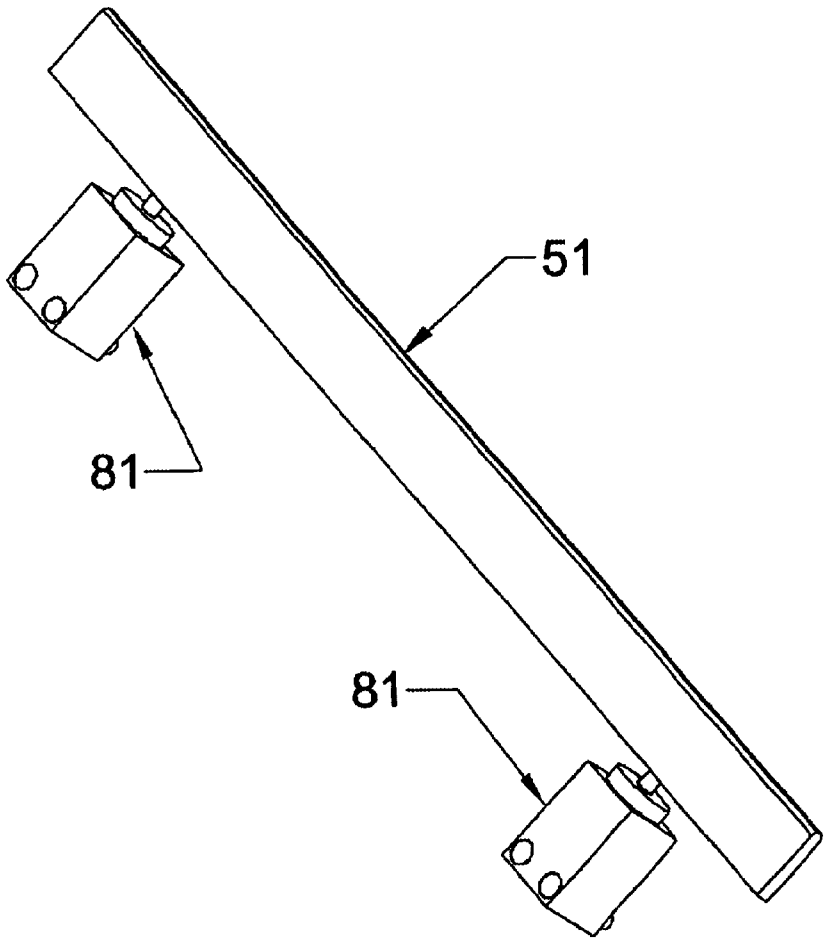
FIG. 18 is an isometric view of one of the wedges and its two actuators used in the system of the invention.

Referring to FIGS. 2–4, 6 and 7, the door 31 comprises an inner core formed by members 61, 63, 65, 67, 69 sandwiched between two outer layers 71 and 73. The door slots 31BS, 31DS and 31CS1, 31CS2 are formed in core members 61, 63 and 65 respectively. Frame members 33A, 33B, 33C and 33D comprise thinner outer portions 33AO, 33BO, 33CO, 33DO and thicker inner portions 33AI, 33BI, 33CI and 33DI. The frame slots 33BS, 33DS, and 33CS1, 33CS2 are formed in the thicker portions 33BI, 33CI, and 33DI respectively. Attached to the outer portions 33BO, 33CO, 33DO, are wedge actuators 81. Each wedge is controlled by two actuators 81 as shown in FIGS. 1, 5, and 18. All of the actuators 81 are identical. FIG. 18 illustrates two of the actuators 81 coupled to wedge 51. The wedge actuators 81 move their wedges from the frame slots into the door slots when the door is in its closed position to secure the door to the frame 33. Before the manner of operation of the actuators 81 is described, the mechanism for automatically closing the door 31 will be described.

Figure 16:
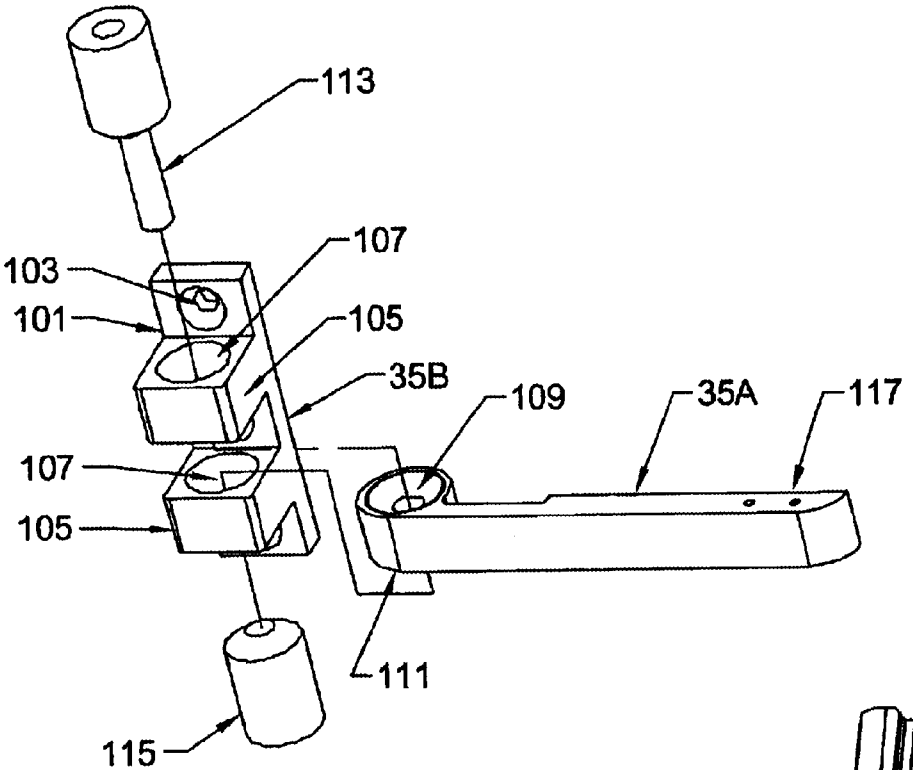
FIG. 16 is an exploded view of one of the non-biased hinges of the door.

Referring to FIG. 16, each of the hinges 35 comprises the member or arm 35A and the base 35B. The base 35B comprises a base plate 101 having two apertures 103 (only one of which is shown) for bolting the base to the frame member 33A. Two spaced apart studs 105 extend from the base plate 101 and have apertures 107 extending therthrough. The hinge member 35A has an aperture 109 formed through its end 111. The end 111 is located between the studs 105 and a pin 113 is located through the apertures 107 and 109 and secured to member 115 to pivotally couple the hinge member 35A to the base member 35B. The outer end 117 of the member 35A is secured to the wall 71 of the door. The hinges 35 allow the door to be moved from a filly closed position 180 degrees to a fully open position.

Figure 9:
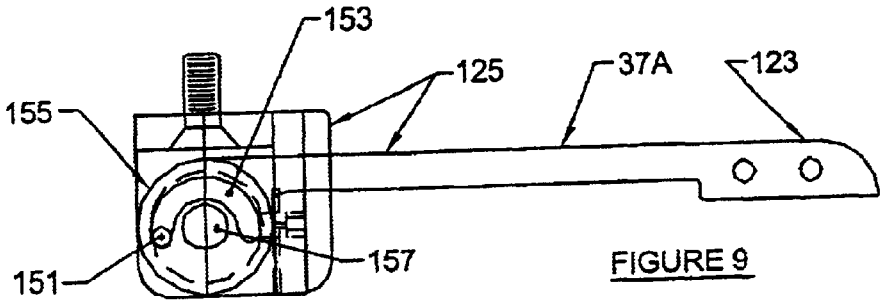
FIG. 9 is an end view of the hinge of FIG. 8 as seen along lines 9—9 thereof.

Referring to FIGS. 8–15, the hinge 37 is similar to hinge 35 in that it includes a member or arm 37A having an end 123 secured to the outer panel 71 of the door and an opposite end 125 pivotally coupled to a base 37B which is secured to the frame such that the door can move from a fully closed position 180 degrees to a fully open position. In FIGS. 8–15, the hinges for the door including hinge 37 are secured to the right edge of the door and frame rather than to the left edge of the door as shown in the embodiment of FIGS. 1–7. The operation of the hinge 37 now will be described for the embodiment of the door wherein the hinges are secured to the right edge of the door and frame rather than to the left edge of the door and frame. The top of the door is above the hinge of FIGS. 8 and 10. The base 37B supports a tension spring 131 having one end 131A coupled to the base 37B and an opposite end 131B coupled to a cam 133 which engages a cam 135. The cam 133 has an elongated slot 133S formed in its side which extends parallel to its axis. A pin 131P is connected to the base 37B which extends into the slot 133S. The pin 131 P prevents the cam 133 from rotating but allows the cam 133 to move linearly. The cam 135 has a semicircle slot 153 formed in its end 135A. The arm 37A of the hinge 37 has a pin 151 connected thereto which is located in the cam slot 153. When the cam 135 is in the position of FIG. 8, it is in a cocked position and the slot 153 is in the position shown in FIGS. 9 and 11A. In this condition, the hinge arm 37A, can be moved from the open position as shown in FIG. 9 clockwise to the closed position as shown in FIG. 11A. In doing so, the pin 151 moves from the position shown in FIG. 9, 180 degrees in the slot 153. Thus when the cam 153 is in the cocked position the door can be opened and closed.

Figure 8:
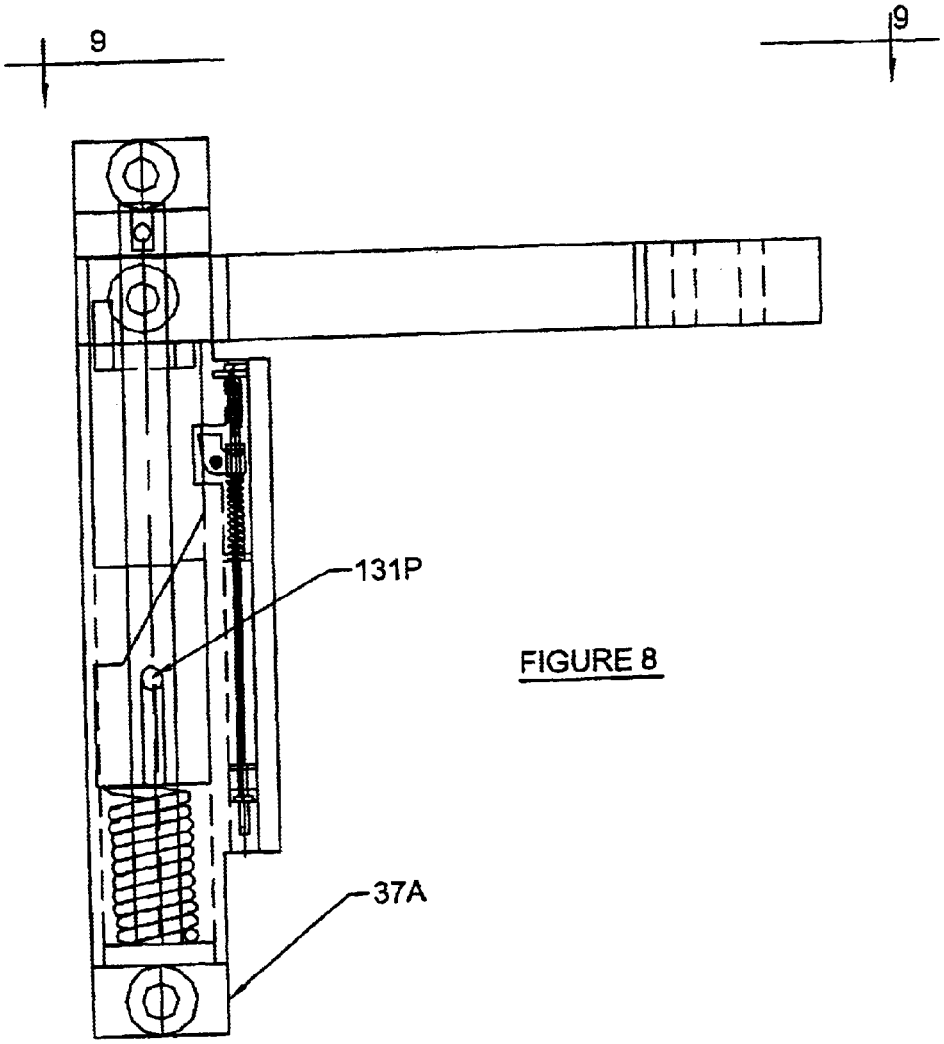
FIG. 8 is a plan view of the spring biased hinge with the door in an open position.
Figure 11:
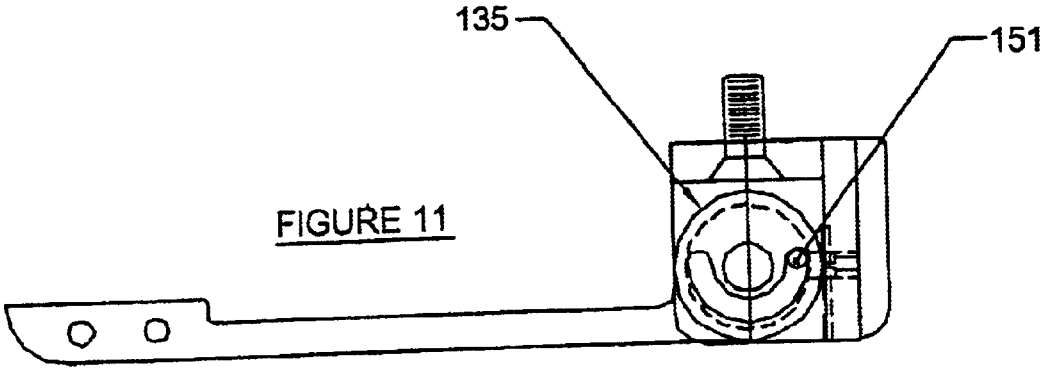
FIG. 11 is an end view of the hinge of FIG. 10 as seen along lines 11—11 thereof.
Figure 10:
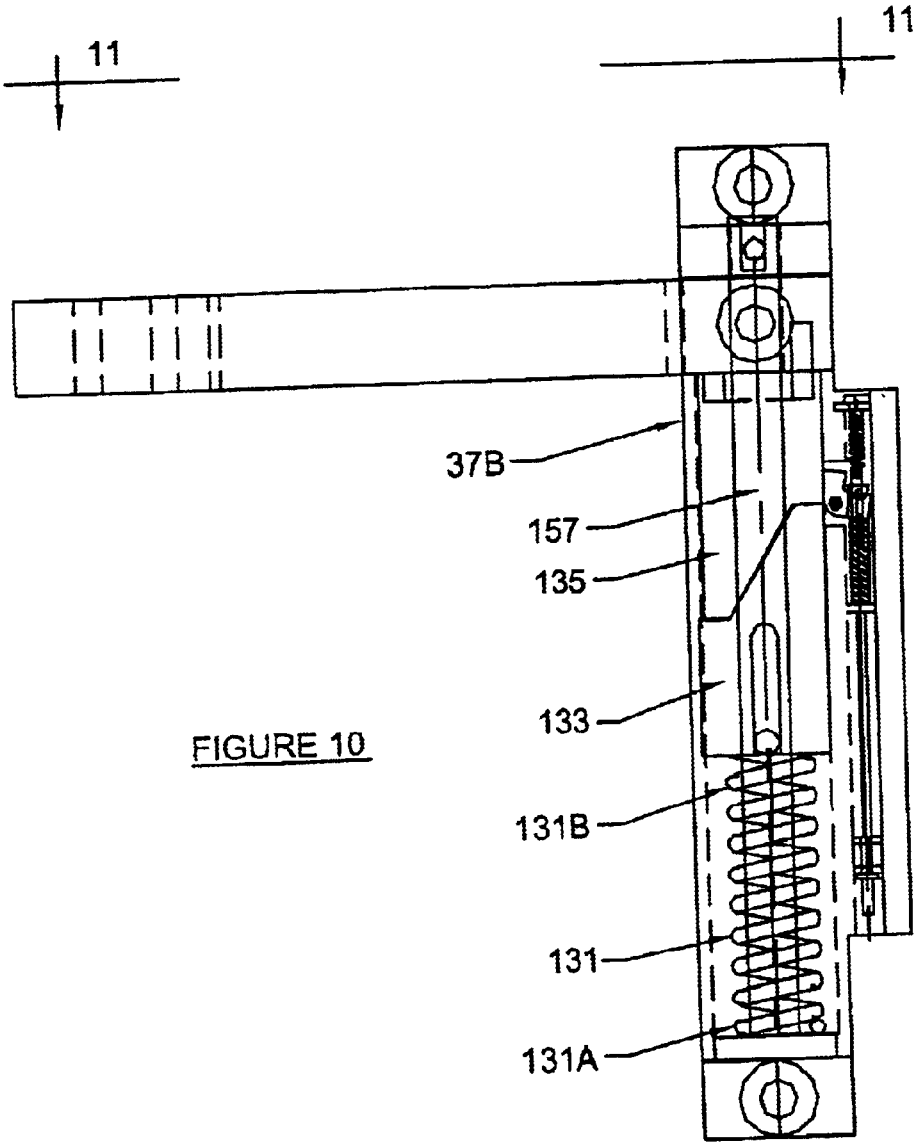
FIG. 10 is a plan view of the hinge of FIG. 8 with the door in a closed position.
Figure 12:
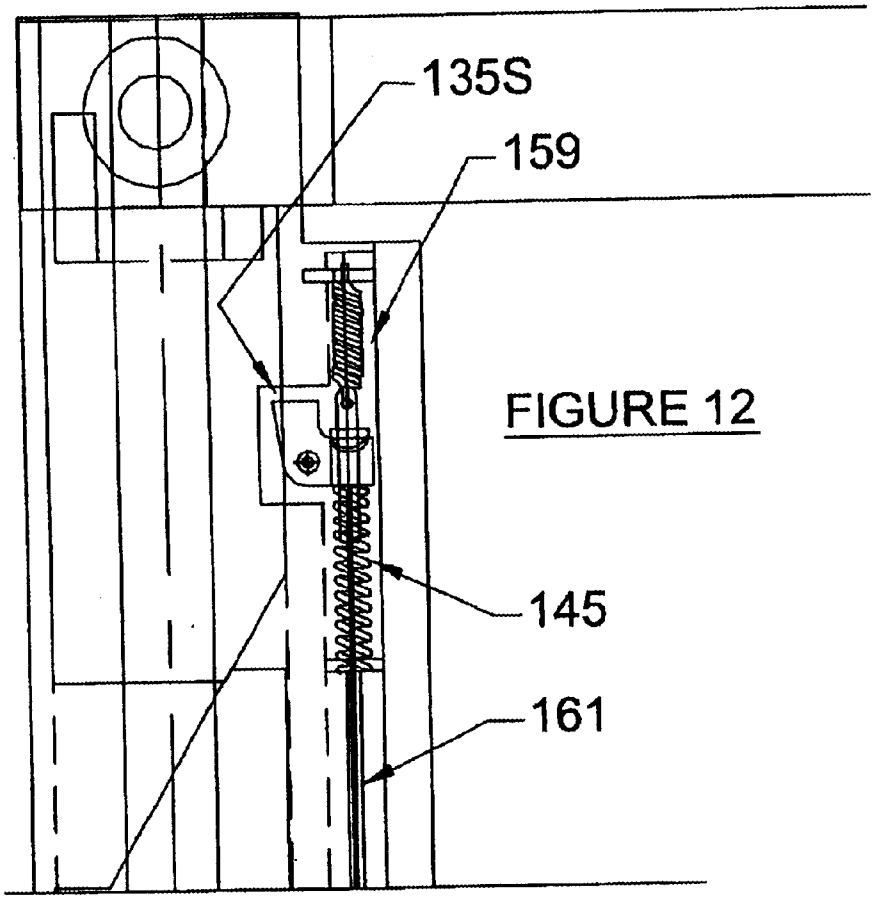
FIG. 12 is an enlarged view of the spring mechanism and trigger of FIG. 8 with the trigger in the a holding position.
Figure 13:
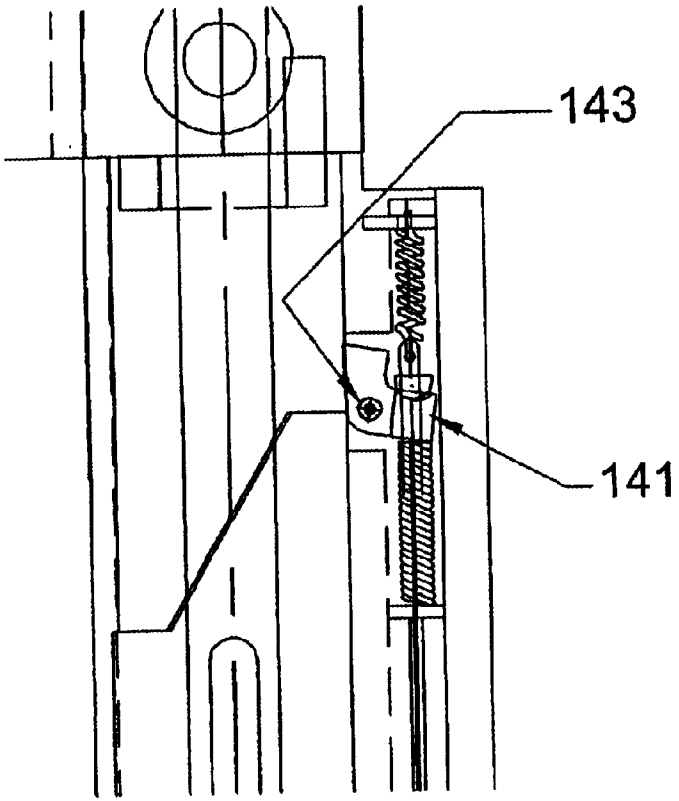
FIG. 13 is an enlarged view of the spring mechanism and trigger of FIG. 10 with the trigger in a release position.
Figure 11A:
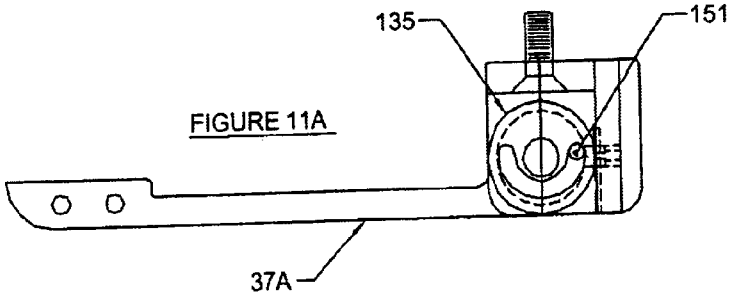
FIG. 11A is a view similar to that of FIG. 11 but with the door rotating cam and spring in a cocked position.

Linear movement of the cam 133 from the position of FIG. 8 to the position of FIG. 10 will cause the cam 135 and hence its slot 153 to rotate 180 degrees clockwise from the position of FIG. 9 to the position of FIG. 11. Assuming that the hinge arm 37A and hence the door is in the open position of FIG. 9, movement of the cam 133 from the cocked position of FIG. 8 to the position of FIG. 10 rotates the cam 135 clockwise to the position of FIG. 11 which rotates the pin 151 and hence the arm 37A and door 31 clockwise to the closed position of FIG. 11.

The cam 135 normally is prevented from rotating by a trigger or lever 141 pivotally coupled to the base 37B by a pin 143 and which trigger is normally held in a slot 135S of the cam 135 by a tension spring 145 which engages the trigger 141 and the base 37B. The hinge member 37A and the cam 135 can rotate about a central pin 157 secured to the base 37B. Another spring 159 is coupled to the trigger 141 and to the base 37B. Also coupled to the trigger 141 and to the base 37B is a SMA (shape memory allow wire) 161. It is of the type that when heated, it contracts in a few milliseconds. The contraction may be of the order of 3–5%. The SMA wire regains its original length in 10–13 seconds dependent on the type of cooling employed. In the present system, when heat is applied to the SMA wire 161 from an electrical pulse, the wire 161 retracts and rotates the trigger 141 clockwise as seen in FIGS. 8, 10, 12, and 13 out of the slot 135S of the cam 135. This allows the spring 131 to expand moving the cam 133 linearly which rotates the cam 135 and hence the pin 151 and the hinge member 37A clockwise (as seen in FIGS. 8–12) 180 degrees and hence the door 31, 180 degrees to a closed position.

When the door 31 closes, it closes a switch which causes all of the actuators 81 to be actuated to cause them to move the wedges 51, 53, 55, and 57 into the door slots to secure the door 31 to the frame 33.

When the wedges are removed from the frame slots, a person may move the door counter-clockwise from the closed position of FIG. 11 to the open position of FIG. 9 which causes the pin 151 to rotate the cam 135 180 degrees counter-clockwise to the cocked position allowing the spring 145 to urge the trigger 141 in the slot 135S.

Figure 15:
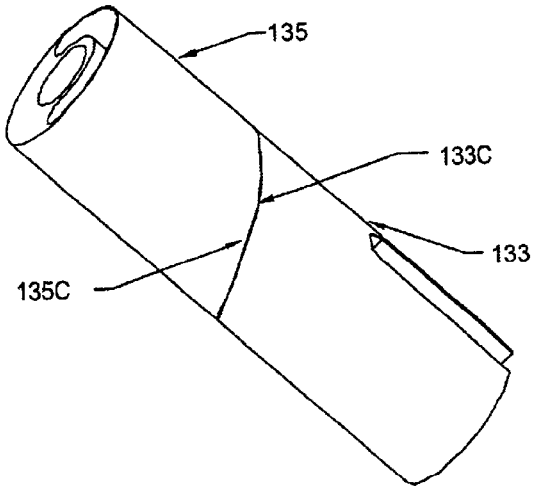
FIG. 15 is another view of the two cams of FIG. 14 when the door is in a closed position.
Figure 14:
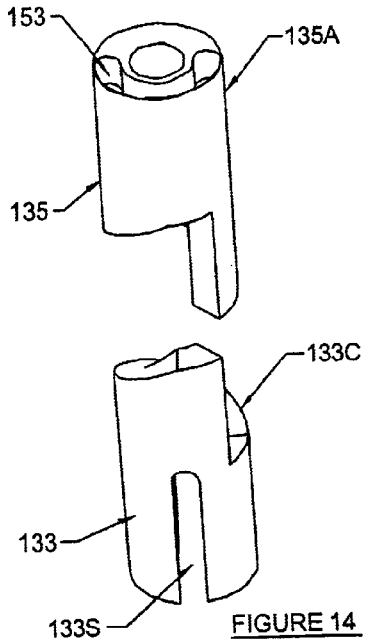
FIG. 14 is an exploded view of two cams employed in the hinge of FIGS. 8–13.

Referring to FIGS. 14 and 15, the two cams 133 and 135 have curved surfaces 133C and 135C which enable the cam 133 to rotate the cam 135 when the cam 133 is moved from the position of FIG. 8 to the position of FIG. 10 and which enables the cam 135 to move cam 133 linearly from the position of FIG. 10 to the position of FIG. 8 when the cam 135 is rotated by the pin 151 to the cocked position.

Figure 19:
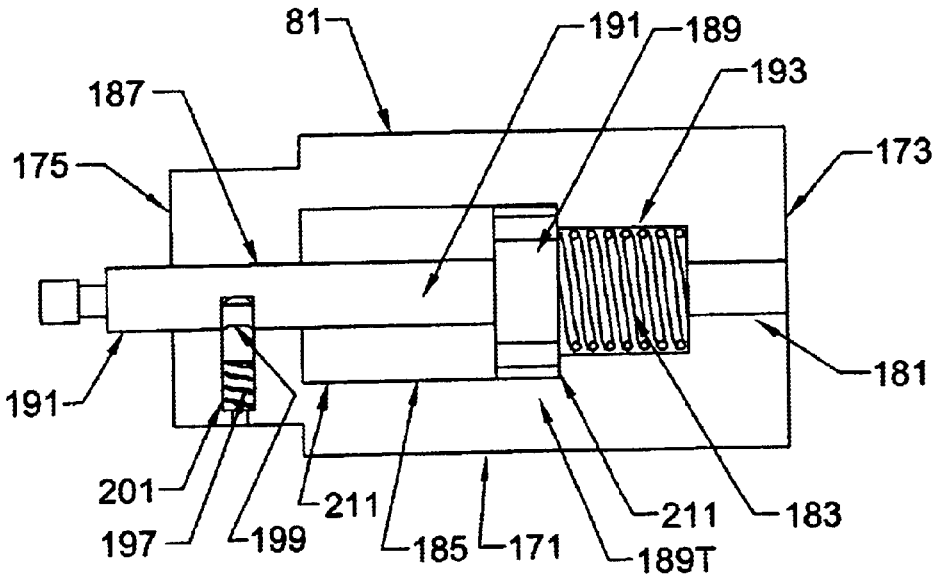
FIG. 19 is a cross-sectional view of one of the actuators of the apparatus of FIG. 17 with its trigger in a holding position.
Figure 20:
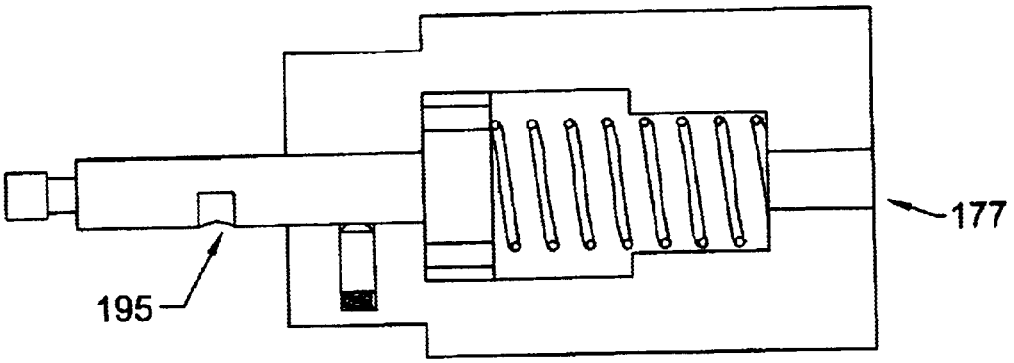
FIG. 20 is a cross-sectional view of the actuator of FIG. 19 with its trigger in a release position and its wedge holding member in an outward position.

Referring to FIGS. 18–20, one of the actuators 81 will be described. It comprises a member having an outer cylindrical wall 171 with opposite ends 173 and 175 with an aperture 177 extending therethrough. The aperture 177 has three different size diameter portions. It comprises a smaller diameter portion 181 extending from end 173 to a larger diameter portion 183 which leads to a still larger diameter portion 185 which in turn leads to a smaller diameter portion 187. A movable piston 189 is located in portion 185. Coupled to the end of the piston 189 is a smaller diameter portion 191 which extends out of aperture portion 187. The end of the piston is connected to one side of a wedge. A spring 193 located in aperture portion 183 normally biases the piston 189 and hence the piston 191 to the left as seen in FIGS. 19 and 20. The piston 191 has a slot 195 formed therein on one side. A cylindrical slot 197 is formed in the member 81 which intercepts the aperture 187. A second trigger or lever 199 is slidably located in the slot 197 and is biased in the slot 195 when the piston 189, 191 is in its retracted position by a SMA wire spring 201 attached to the trigger 199. In order to actuate the actuator, an electrical pulse is applied to the SMA wire spring 201 to retract the spring 201 and hence move the trigger 199 out of the slot 195 to release the piston 189, 191. The spring 193 then moves the piston 189, 191 to an extended position to the left as seen in FIGS. 18 and 19 which moves its wedge into the door slot. A narrow slot 211 parallel with the axis of aperture 185 is formed next to aperture 185 for slidably receiving a tongue 189 attached to piston member 189 to keep slot 195 aligned with trigger aperture 197.

Figure 21:
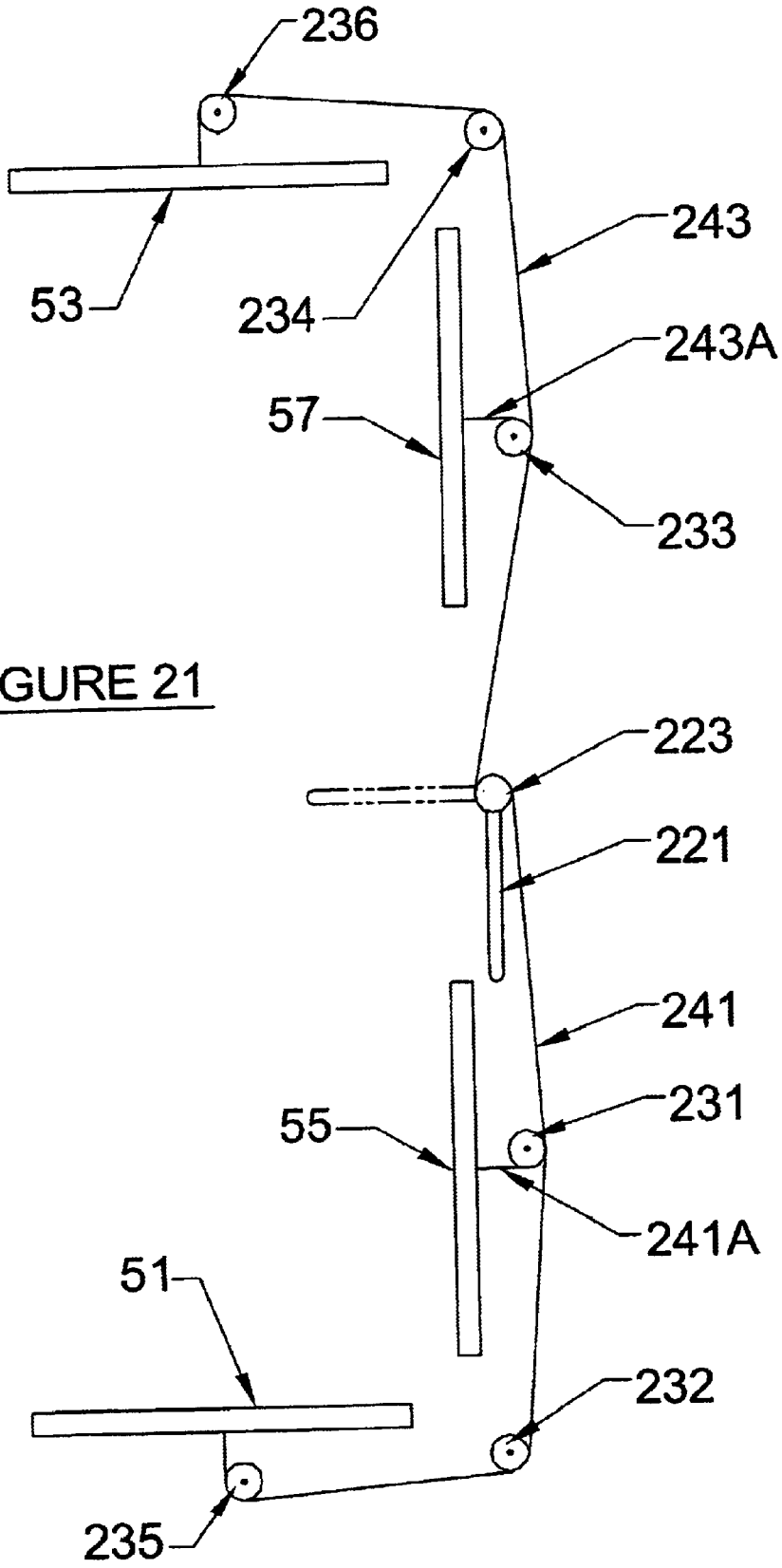
FIG. 21 illustrates a manual system for moving the wedges of the apparatus out of the door slots and into their frame slots.

Referring to FIGS. 1 and 21, a handle 221 rotatably coupled to the frame member 33C by a rod 223 is provided for moving the wedges out of the door slots when it is desired to open the door. A plurality of pulleys 231–234 are rotatably coupled to the frame member 33C. Also rotatably coupled to frame members 33C and 33D are pulleys 235 and 236. Flexible cords 241 and 243 are connected to the rod 223. Cord 241 engages pulleys 231, 232 and 235 and is connected to wedge 51. A short flexible cord 241A is connected to cord 241 and to wedge 55. Cord 241A also engages pulley 231. Cord 243 engages pulleys 233, 234, and 236 and is connected to wedge 53. A short flexible cord 243A is connected to cord 243 and to wedge 57. Cord 243A also engages pulley 233. When the wedges are located out of the door slots, the handle 221 extends vertically downward as shown in FIGS. 1 and 21. When the wedges are moved into the door slots, the cords 241, 241A, 243, 243A move the rod 223 and hence the handle 221 to a horizontal position as shown in FIG. 5 and in dotted line in FIG. 21. In order to move the wedges out of the door slots, the handle 221 is rotated downward which wraps the cords 241 and 243 around the rod 223 and causes cords 241, 241A, 243, 243A to move the wedges out of the door slots.

Referring now to FIGS. 22 and 23, there will be described a circuit 269A for actuating the SMA wire 161 and a circuit 269B for actuating the SMA wires 201 of the actuators 81. A control signal is applied by way of lead 269AC to circuit 269A and to circuit 269B. The circuit 29A comprises a normally open switch 271, a timer IC(Integrated Circuit) 273, a transistor 275 which are connected to the SMA wire 161 and a (battery) DC power supply 277. The circuit 269B is similar to circuit 269A and is coupled to each of the SMA wires 201 of the actuators 81. The switch 271 is shown to be a mechanical switch, however, it is to be understood that it will be an electronic switch. When the switch 271 of the circuit 269A is closed by the control signal, an electrical pulse will be applied to the SMA wire 161 to cause the door 31 to close. When the control signal is applied to switch 271 of circuit 269B, the timer 273 of circuit 269B delays until the estimated time that the door closes before its transistor 275 is actuated. When the door closes, it closes switch 281 and allows the output of circuit 269B to be applied to all of the SMA wires 201 to actuate all of the actuators 81 to move all of the wedges into the door slots.

A single battery 277 may be employed to supply power to all of the circuits 269A and 269B.

Figure 24:
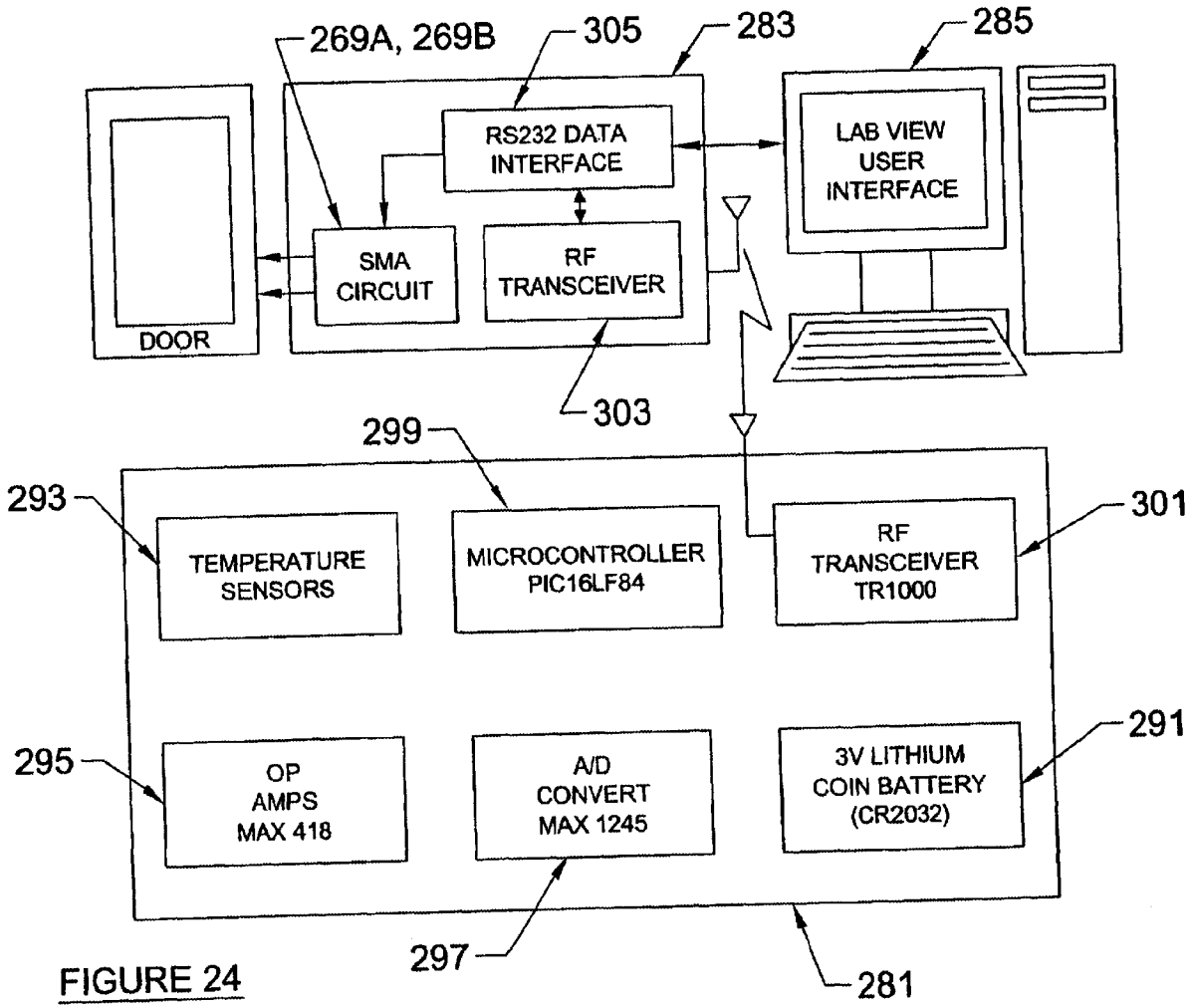
FIG. 24 is a block diagram of the system for controlling all of the modules.

Referring to FIG. 24, the control system comprises a sensor unit 281, an interrogator unit 283, and a main control unit 285 which comprises a computer. The sensor unit 281 comprises a DC power supply 291, sensors such as temperature sensors 293, amplifiers 295, A/D converter 297, a microcontroller 299 and a radio frequency transceiver 301.

The interrogator unit 283 comprises a radio frequency transceiver 303 which receives information from the transceiver 301 and outputs the data to the data interface 305 which is coupled to the unit 285 and to the SMA driving circuits 269A and 269B. When high temperature is sensed, the data is transmitted to the transceiver 301 and if the temperature is of the type to indicate an emergency, the door is closed and the driving circuit 269B applies a pulse to all of the SMA wires 201 to move all of the wedges into the door slots. When the emergency is over, the handle 221 is moved to retract all of the wedges from the door slots to allow the door to be opened.

The sensors may be other types of sensors such as pressure sensors.

In one embodiment, the SMA wires may be of the type manufactured by Dynalloy, Inc. of California, and identified as FLEXINOL 250® having the following parameters.

| | |
|---|---|
| Wire Diameter: | 250 μm [0.01"] |
| Minimum bend radius: | 12.5 mm [0.5"] |
| Recommended recovery strength: | 930 g [2 lbs.) |
| Recommended deformation strength: | 172 g [.380 lbs.] |
| Contraction speed: | 0.1 sec. |
| Relaxation speed: | 5.5 sec. |
| Electrical Resistance: | 20 ohm/m |
| Recommended current: | 1000 ma |
| Recommended power: | 20 w/m |

Figure 17:
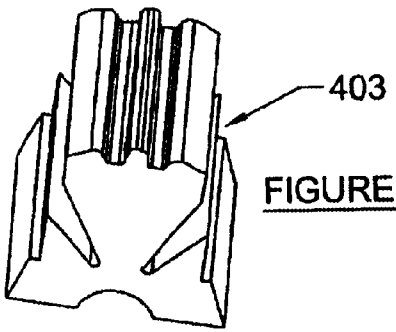
FIG. 17 is and end view of one of the door seals shown in FIGS. 2, 3, 4, 6, and 7.

Referring to FIGS. 2, 3, 4, 6, and 7 door frame members 33A, 33B, 33C, and 33D each have two slots 301 for receiving two flexible seals 403 for engaging the door 31 when it is in a closed position to form a seal between the door and the frame. Each seal 403 is shown in more detail in FIG. 17. As an alternative, each door frame member 33A, 33B, 33C, 33D may have a single slot 301 on its outer side for receiving a seal 403.

Figure 3:
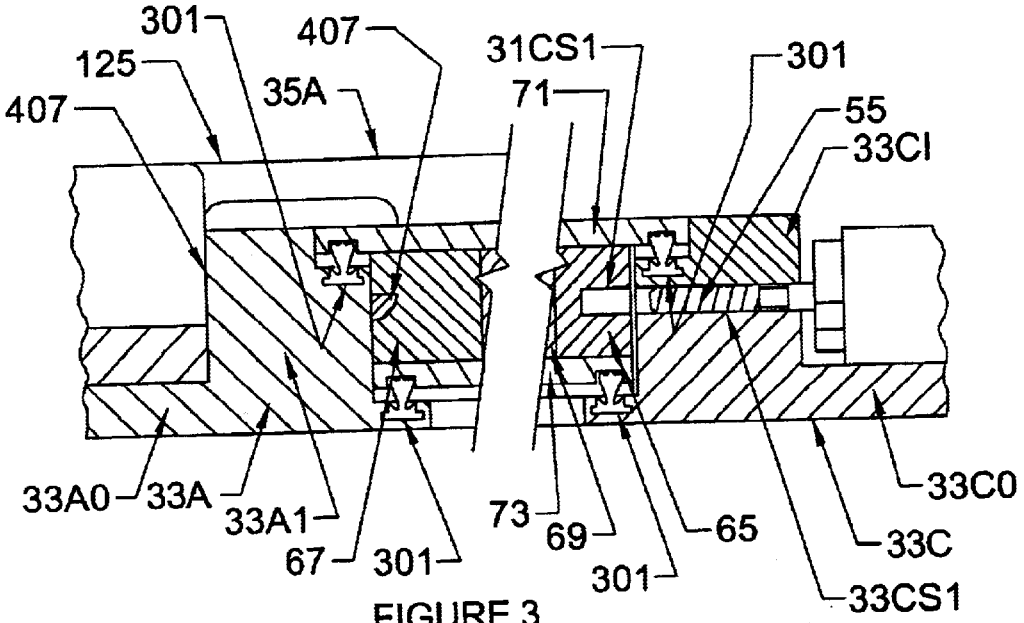
FIG. 3 is a cross-section of FIG. 1 taken along the lines 3—3 thereof.
Figure 4:
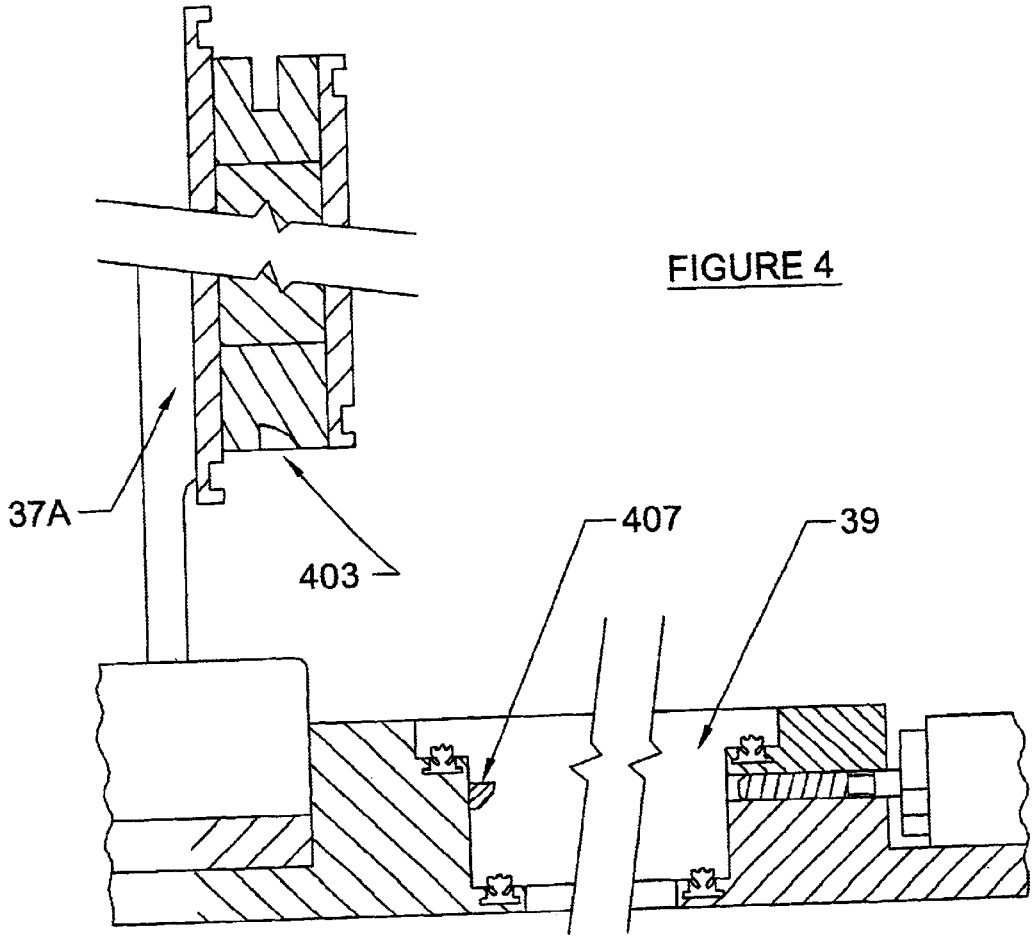
FIG. 4 is a view similar to that of FIG. 3 but with the door open about 90 degrees.

Referring to FIGS. 1, 3, and 5 a stationary flexible seal 405 may be secured to the frame 33A on its inner side which will fit in a corresponding slot 407 formed in the edge of the door 31 next to the frame 33A when the door is in a closed position.

Although not shown, the handle 221 may be mechanically coupled to each of the triggers 199 to allow the triggers 199 to be moved manually out of the slots 195 in the event that electrical power fails, to allow the springs 193 to move the wedges into the door slots.

What is claimed is:

1. An apparatus for closing a door comprising:

a frame having first and second spaced apart frame side members defining a passageway, a door having first and second door side edges, an upper door edge and a lower door edge, hinge means for pivotally securing said first door side edge to said first frame side member to allow said door to move to an open position and to a closed position, in said closed position said second door side edge is located next to said second frame side member, closing means coupled to said first frame side and to said first door side for moving said door to said closed position, a trigger coupled to said first frame side member for movement between a first position for preventing said closing means from moving said door to said closed position and second a position for allowing said closing means to move said door to said closed position, biasing means for normally holding said trigger in said first position, a shaped memory wire coupled to said first frame member and to said trigger, said shape memory wire being characterized in that it retracts to a contracted condition when heated and expands from said contracted condition when it cools, and electrical means for heating said shape memory wire for moving said trigger to said second position for allowing said closing means to move said door to said closed position.

2. The apparatus of claim 1, wherein:

said second frame side member has a frame slot formed therein, said second side door edge has a door slot formed therein, a wedge supported for movement in said frame slot, support means coupled to said second frame side member and to said wedge for moving said wedge between an inward position away from said door slot and an outward position into said door slot when said door is in said closed position, biasing means for normally urging said support means and hence said wedge toward said outward position, a second trigger supported for movement between a holding position for holding said support means and hence said wedge in said inward position and a release position for allowing said wedge to be moved to said outward position, a second shape memory wire coupled to said second frame side member and to said second trigger, said second shape memory wire being characterized in that it retracts to a contracted condition when heated and expands from said contracted condition when it cools, electrical means for heating said second shape memory wire for retracting said second trigger from said holding position to said release position for allowing said support means and hence said wedge to move to said outward position into said door slot.

3. An apparatus for securing a door in a closed position, comprising:

a frame having first and second spaced apart frame side members defining a passageway, a door having first and second door side edges, an upper door edge and a lower door edge, hinge means for pivotally securing said first door side edge to said first frame side member to allow said door to move to an open position and to a closed position, in said closed position said second door side edge is located next to said second frame side member, said second frame side member has a frame slot formed therein, said second side door edge has a door slot formed therein, a wedge supported for movement in said frame slot, support means coupled to said second frame side member and to said wedge for moving said wedge between an inward position away from said door slot and an outward position into said door slot when said door is in said closed position, biasing means for normally urging said support means and hence said wedge toward said outward position, a trigger supported for movement between a holding position for holding said support means and hence said wedge in said inward position and a release position for allowing said wedge to be moved to said outward position, a shape memory wire coupled to said second frame side member and to said trigger, said shape memory wire being characterized in that it retracts to a contracted condition when heated and expands from said contracted condition when it cools, electrical means for heating said shape memory wire for retracting said trigger from said holding position to said release position for allowing said support means and hence said wedge to move to said outward position into said door slot.

4. An apparatus for securing a door in a frame, comprising:

a frame having first and second frame side members, an upper frame member, and a lower frame member defining a passageway, a door having first and second door side edges, an upper door edge and a lower door edge, hinge means for pivotally securing said first door side edge to said first frame side member to allow said door to move to an open position and to a closed position, in said closed position said second door side edge is located next to said second frame side member, said upper door edge is located next to said upper frame member and said lower door edge is located next to said lower frame member, at least one of said frame member having an elongated frame slot formed therein, said door edge located next to said one frame member when said door is in said closed position having an elongated door slot formed therein, a wedge supported in said one frame slot, support means coupled to said one frame member and to said wedge for moving said wedge between an inward position away from said door slot and an outward position into said door slot when said door is in said closed position, biasing means for normally urging said support means and hence said wedge toward said outward position, a trigger supported for movement between a holding position for holding said support means and hence said wedge in said inward position and a release position for allowing said wedge to be moved to said outward position, a shape memory wire coupled to said second frame side member and to said trigger, said shape memory wire being characterized in that it retracts to a contracted condition when heated and expands from said contracted condition when it cools, electrical means for heating said shape memory wire for retracting said trigger from said holding position to said release position for allowing said support means and hence said wedge to move to said outward position into said door slot.

5. An apparatus for closing a door, comprising:

a frame having first and second frame side members, an upper frame member, and a lower frame member defining a passageway, a door having first and second door side edges, an upper door edge and a lower door edge, hinge means for pivotally securing said first door side edge to said first frame side member to allow said door to move to an open position and to a closed position, in said closed position said second door side edge is located next to said second frame side member, said upper door edge is located next to said upper frame member and said lower door edge is located next to said lower frame member, closing means coupled to said first frame side and to said first door side for moving said door to said closed position, a trigger coupled to said first frame side member for movement between a first position for preventing said closing means from moving said door to said closed position and a second position for allowing said closing means to move said door to said closed position, biasing means for normally holding said trigger in said first position, a shaped memory wire coupled to said first frame member and to said trigger, said shape memory wire being characterized in that it retracts to a contracted condition when heated and expands from said contracted condition when it cools, and electrical means for heating said shape memory wire for moving said trigger to said second position for allowing said closing means to move said door to said closed position.

6. The apparatus of claim 5, comprising:

at least one of said frame member having an elongated frame slot formed therein, said door edge located next to said one frame member when said door is in said closed position having an elongated door slot formed therein, a wedge supported in said one frame slot, support means coupled to said one frame member and to said wedge for moving said wedge between an inward position away from said door slot and an outward position into said door slot when said door is in said closed position, biasing means for normally urging said support means and hence said wedge toward said outward position, a trigger supported for movement between a holding position for holding said support means and hence said wedge in said inward position and a release position for allowing said wedge to be moved to said outward position, a shape memory wire coupled to said second frame side member and to said trigger, said shape memory wire being characterized in that it retracts to a contracted condition when heated and expands from said contracted condition when it cools, electrical means for heating said shape memory wire for retracting said trigger from said holding position to said release position for allowing said support means and hence said wedge to move to said outward position into said door slot.

7. The apparatus of claim 5, wherein said closing means comprises:

a first cam coupled to said first side frame member, means for supporting said first cam for linear movement between a cocked position and an extended position, a second cam coupled to said first side frame member and to said hinge means, means for supporting said second cam for rotation about 180 degrees between a first position and a second position, said first and second cams have first and second surfaces respectively which engage each other such that when said first cam moves from said cocked position to said extended position said second cam is rotated to said second position to move said hinge means and hence said door to a closed position and when said second cam is rotated from said second position to said first position, said second cam moves said first cam to said cocked position, a spring coupled to said first cam and to said first side frame member for urging said first cam to said extended position.

* * * * *